United States Patent [19]

Koncelik et al.

[11] 4,404,698

[45] Sep. 20, 1983

[54] OVERBED TRAY ARRANGEMENT

[75] Inventors: Joseph A. Koncelik, Worthington; David B. Chaney, Powell, both of Ohio; Walter G. Lockard, Quakertown, Pa.; Kevin J. Reeder, Columbus, Ohio; Thomas D. Hontz, Quakertown, Pa.

[73] Assignee: Burlington Industries, Inc., Greensboro, N.C.

[21] Appl. No.: 188,473

[22] Filed: Sep. 18, 1980

[51] Int. Cl.[3] ..... A47B 23/02

[52] U.S. Cl. ..... 5/507; 24/257; 108/49; 297/153

[58] Field of Search ..... 5/507, 503, 508, 425, 5/53 R, 53 C, 444; 108/49, 47; 297/148, 153; 24/257

[56] References Cited

U.S. PATENT DOCUMENTS

| | | | |
|---|---|---|---|
| 1,134,724 | 4/1915 | Bradley | 108/49 |
| 1,308,034 | 7/1919 | Bonnifield | 108/49 |
| 2,468,412 | 4/1949 | Schaefer | 108/49 |
| 2,483,920 | 10/1949 | McLean et al. | 5/507 |
| 2,484,401 | 10/1949 | Cole | 403/108 |
| 2,547,642 | 4/1951 | Heuser | 5/507 |
| 2,679,283 | 5/1954 | Mahone . | |
| 2,963,761 | 12/1960 | Haydock | 297/153 |
| 3,062,602 | 11/1962 | O'Brien et al. . | |
| 3,346,125 | 10/1967 | Miller et al. | 108/49 |
| 3,382,545 | 5/1968 | Spenner | 24/257 |
| 3,813,714 | 6/1974 | Sater | 108/49 |
| 4,332,042 | 6/1982 | Koncelik | 5/53 R |

FOREIGN PATENT DOCUMENTS

| | | | |
|---|---|---|---|
| 202442 | 6/1967 | Fed. Rep. of Germany | 5/507 |
| 91973 | 5/1969 | Fed. Rep. of Germany . | |
| 1541314 | 7/1969 | Fed. Rep. of Germany . | |
| 841588 | 5/1939 | France . | |
| 1087938 | 3/1955 | France . | |
| 1131025 | 2/1957 | France . | |
| 1193130 | 10/1959 | France . | |
| 1374898 | 8/1964 | France | 5/507 |
| 70735 | 5/1927 | Sweden . | |
| 83821 | 5/1935 | Sweden . | |
| 360258 | 12/1973 | Sweden . | |
| 910436 | 11/1962 | United Kingdom . | |

*Primary Examiner*—Alexander Grosz

*Attorney, Agent, or Firm*—Cushman, Darby & Cushman

[57] ABSTRACT

A tray assembly is provided particularly for utilization with a nursing home bed or the like. The tray includes a substantially flat support surface that gently slopes downwardly from the head portion to the foot portion of the tray, with a vertical lip upstanding from the support surface around the entire tray circumference. A pair of U-shaped rods are provided for mounting the tray on supporting rails of varying spacings, clips of flexible material being mounted on cross portions of the U-shaped rods to attach to appropriate rail sections. The bed toe board mounts rail sections that also can receive the tray so that the tray covers the toe board when not in use.

20 Claims, 6 Drawing Figures

OVERBED TRAY ARRANGEMENT

BACKGROUND AND SUMMARY OF THE INVENTION

The invention relates to a tray assembly, particularly for use in nursing homes with nursing home bed assemblies. A system defining a particular nursing home environment is disclosed in copending application Ser. No. 136,095 filed Mar. 31, 1980 now U.S. Pat. No. 4,332,042 (the disclosure of which is hereby incorporated by reference herein), and the tray assembly according to the present invention is designed to form a part of that system. The tray assembly according to the invention is constructed with the nursing home environment in mind and when integrated with a system such as disclosed in said application Ser. No. 136,095 provides safety, comfort, control, and a sense of personal ownership for aging people occupying the nursing home.

According to one aspect of the present invention, a tray assembly is provided having a body including a head portion, foot portion, a pair of parallel side portions, and a substantially flat support surface that gently slopes downwardly from the head to the foot portion. A vertical lip is provided upstanding from the support surface preferably around the entire circumference thereof, but at least at the foot portion and portions of the side portions adjacent the foot portion. The vertical lip and the gentle slope of the support surface insure that any liquids or the like that are spilled will be maintained on the tray and will not spill off onto the bed. The assembly further comprises means for mounting the body on a pair of generally parallel horizontally spaced supports so that an individual utilizing the tray can eat off of or write on the tray with the tray securely supported by the supports. Preferably a cutout is formed in the tray head portion for allowing an individual utilizing the tray to position themself so that side portions of the tray are on either side of the individual's body, facilitating use of the tray.

According to another aspect of the present invention a tray assembly is provided comprising a body having a substantially flat support surface and adjustable means for mounting the body on a pair of parallel spaced supports so that the body may be securely supported by support structures having varying horizontal spacings. The mounting means comprises a pair of substantially U-shaped rods, each having a pair of legs and a cross portion. A support-engaging member is mounted on each cross portion and channel-defining means are formed in association with the bottom of the tray body for mounting the rod legs for movement toward and away from side portions of the tray body. The channel-defining means preferably are formed by passageways formed in the tray bottom and a pair of extension brackets cooperating with the passageways in the tray bottom. The support engaging members preferably comprise clips formed of flexible material and having semicircular portions for actually engaging the supports with a circumferential extent of greater than 180°.

According to a further aspect of the present invention a bed assembly is provided including a mattress, mattress supporting structure including a toe board, a pair of rails, and means for mounting the rails so that a rail is disposed along each side of the mattress, at least adjacent the head portion of the mattress, the rails being substantially parallel and adapted to be disposed at the same vertical height. The tray assembly according to the invention is associated with the bed assembly. Preferably the toe board comprises a pair of spaced rail sections attached thereto and upstanding therefrom and having substantially the same configuration as the bed rails. The means for mounting the body portion of the tray include means for mounting rail-engaging members so that the spacing thereof may be adjusted so that they may be mounted either on the rails or on the rail sections. The cutout formed in the head portion of the tray insures that the tray will not interfere with bed hardware when mounted on the rail sections, in addition to facilitating use by an individual on the mattress when the tray is mounted on the rails.

It is the primary object of the present invention to provide a tray assembly, and a bed assembly utilizing same, particularly taking into account the needs of aging people occupying nursing homes (although being applicable to other uses as well). This and other objects of the invention will become clear from an inspection of the detailed description of the invention, and from the appended claims.

DETAILED DESCRIPTION OF THE DRAWINGS

Figure 1:
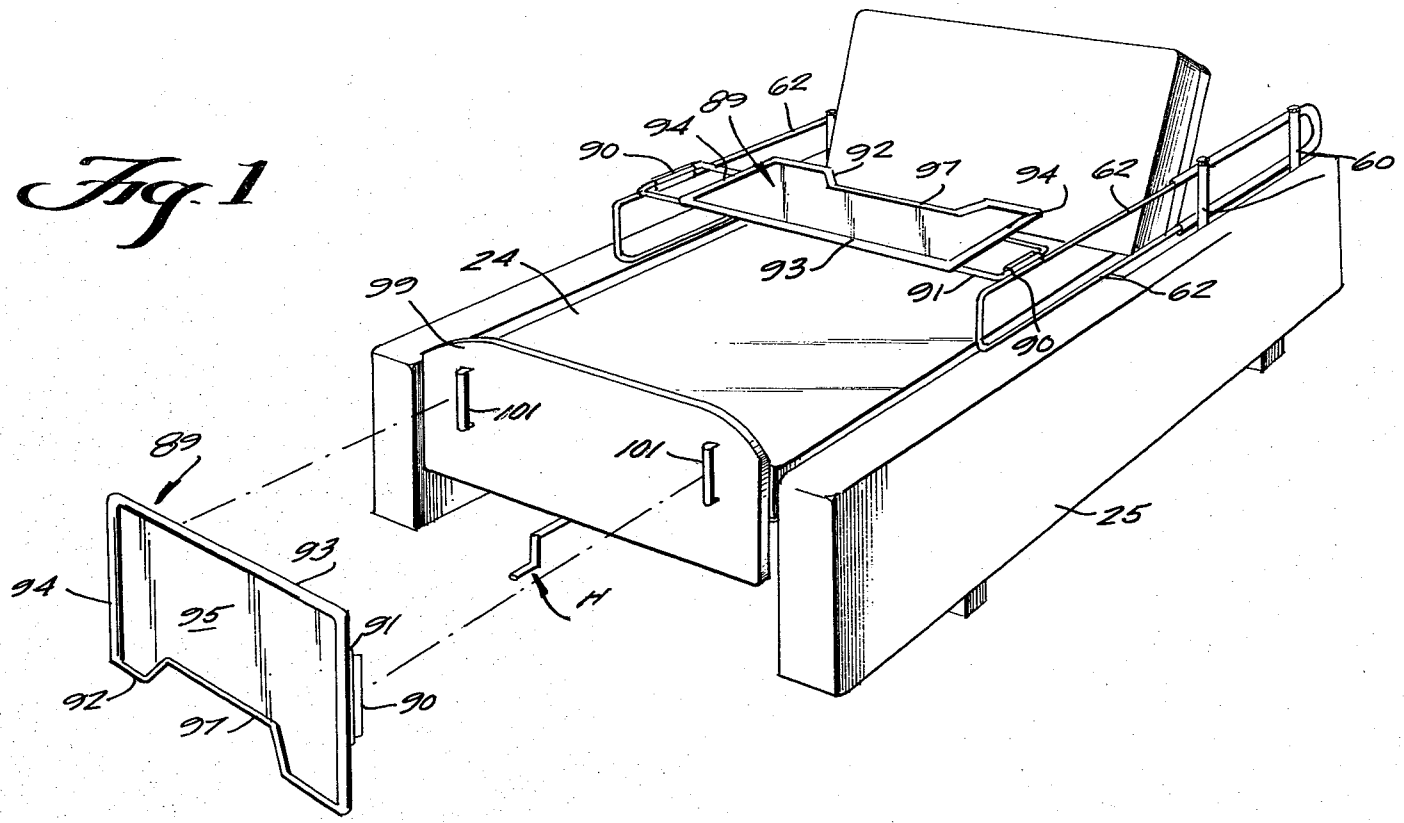
FIG. 1 is a perspective view of any exemplary bed assembly according to the present invention illustrating a tray assembly according to the present invention both in use on bed rails, and in a storage position in cooperation with the bed toe board.

FIG. 1 illustrates an exemplary bed assembly according to the invention including an exemplary tray assembly according to the invention. The bed assembly includes a mattress 24 which may have bolsters 25 disposed along either side thereof as more fully explained in copending application Ser. No. 136,095 now U.S. Pat. No. 4,332,042. A conventional mattress supporting structure is provided for the mattress 25, including a toe board 99. Conventionally some sort of bed hardware, such as a handle H, is associated with the mattress supporting structure for articulating and/or adjusting the height of the mattress 24. The bed assembly further comprises a pair of rails 62 with means (such as posts 60 mounted on bolsters 25) for mounting the rails so that a rail 62 is disposed along each side of the mattress at least adjacent the head portion of the mattress, the rails being substantially parallel and adapted to be disposed at the same vertical height. Preferably both the vertical position and the horizontal extent of the rails 62 are adjustable, as more fully disclosed in application Ser. No. 136,095 now U.S. Pat. No. 4,332,042.

The tray assembly according to the present invention is illustrated generally at 89. The tray assembly 89 is designed to be conveniently used by a person sitting on the mattress, both for writing and eating, and additionally may be stored in a convenient location where it does not interfere with other uses of the bed, and in fact covers the conventionally unsightly toe board 99 of the bed. The cooperation of the tray assembly 89 with the toe board 99 is indicated in exploded form in FIG. 1.

The tray assembly 89 includes rail-engaging members, such as clips 90 of flexible material, which are adapted to receive the rails 62, and further are adapted to receive rail sections 101 mounted on toe board 99. The rail sections 101 have substantially the same configuration as the bed rail 62, and upstand from the toe board 99 as illustrated in FIG. 1.

Figure 2:
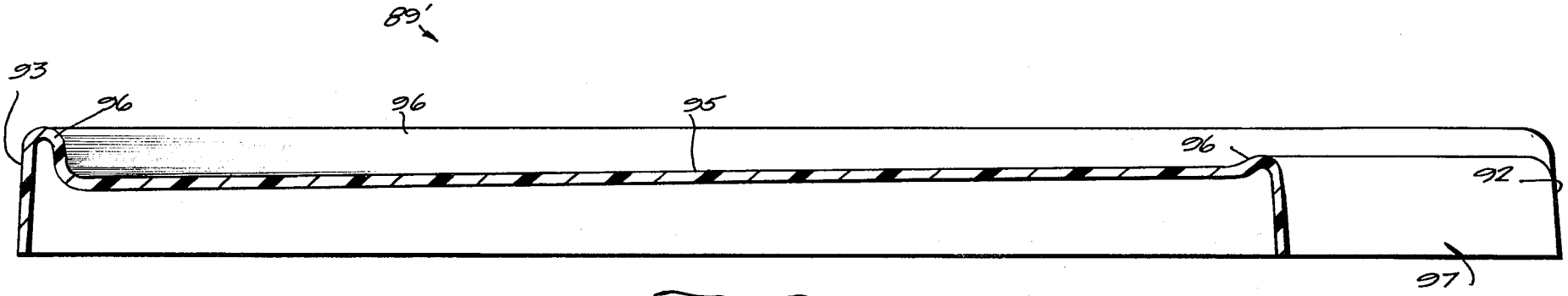
FIG. 2 is a cross-sectional view of the top half of the tray illustrated in FIG. 1.
Figure 3:
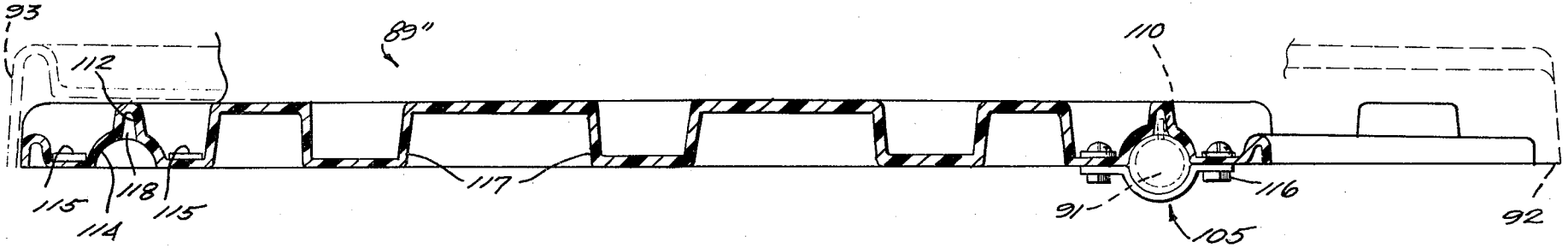
FIG. 3 is a cross-sectional view of the bottom half of the tray illustrated in FIG. 1.

The tray assembly 89 includes a body preferably formed by a top body portion 89' (see FIG. 2) and a bottom body portion 89'' (see FIG. 3). The top and bottom portions have corresponding circumferential definitions so that they fit together to form the body, as illustrated in FIGS. 1 and 3. The portions 89', 89'' preferably are vacuum-formed from a suitable plastic and are bonded together to form the final tray body.

The tray body, particularly the top portion 89', has a head portion 92, foot portion 93, a pair of parallel side portions 94, and a substantially flat support surface 95 that gently slopes downwardly (e.g., about 0.5°) from the head portion 92 to the foot portion 93. A vertical lip 56 upstands from the flat surface 95 preferably around the entire circumference of the surface 95, but at least along the foot portion 93 and portions of the sides 94 adjacent the foot portion 93. As illustrated in the drawings the lip 96 preferably is smaller at the head portion 92. The gentle slope of the support surface 95 combined with the vertical lip 96 insures that any liquid spilled on the tray will be contained on the tray and not spill over onto the mattress 24.

Means are provided defining a cutout 97 in the head portion 92 of the tray body (both the top portion 89' and bottom portion 89''). The cutout 97 performs several functions. It allows an individual utilizing the tray to position himself/herself so that portions of the tray 89 are on either side of the individual's body, thus facilitating use of the tray. Additionally, the cutout insures that the tray will not interfere with conventional bed hardware (e.g., crank H in FIG. 1) when mounted on the rail sections 101 covering the toe board 99.

Figure 4:
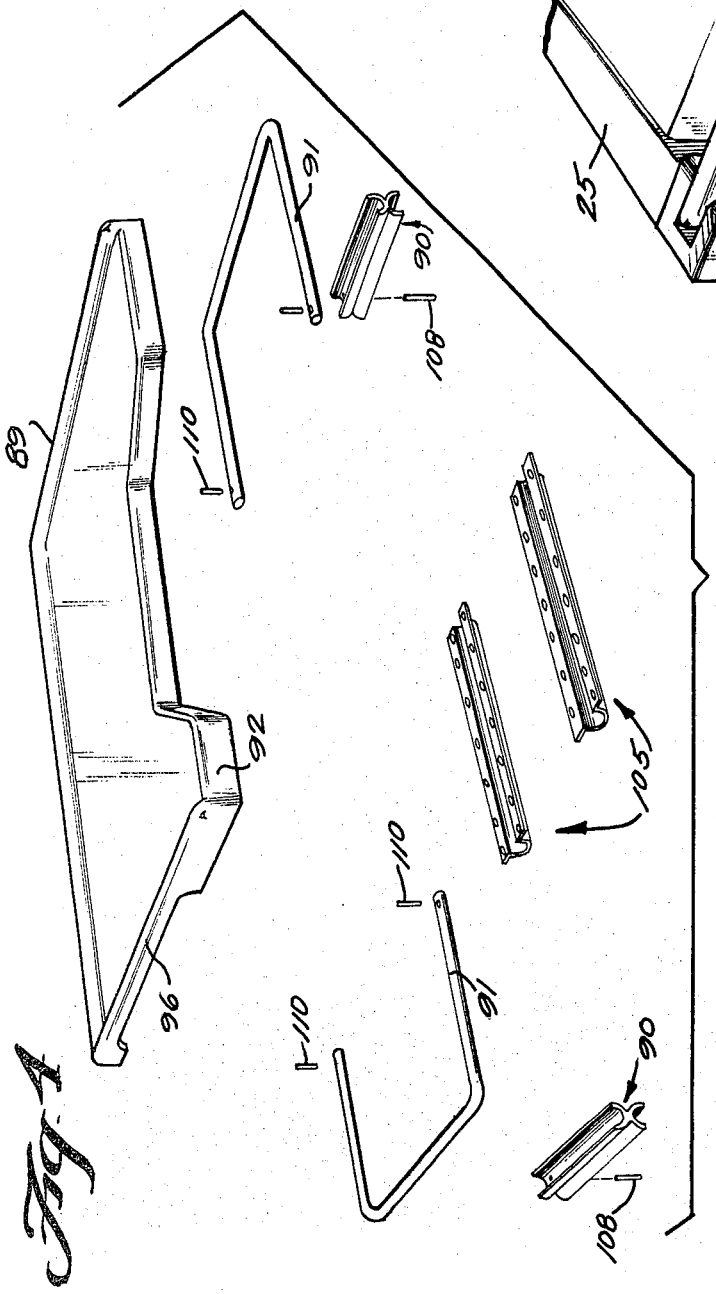
FIG. 4 is an exploded view of an exemplary tray assembly according to the invention.

Means are provided for mounting the tray so that the tray may be securingly supported by support structures having varying horizontal spacing; that is the tray may be mounted by the rail 62 or by the rail sections 101, or by other structures having rail configurations corresponding to 62 or 101 having varying spacings (such as wheel chair arms). The mounting means preferably comprise a pair of substantially U-shaped rods 91, and channel-defining means formed in association with the body 89'' of the tray body for mounting the legs of the rods for movement toward and away from side portions 94 of the tray. The rail-engaging members 90 are mounted on the cross portions of the U-shaped rods 91. Typically, as illustrated most clearly in FIGS. 4 and 5, the rail-engaging members 90 will comprise clips of flexible material (such as extrusions of flexible plastic) having a semicircular portion 106 corresponding to the circumference of the body cross portion 91 and riveted thereto, and a semicircular actual rail-engaging portion having a circumferential extent slightly greater than 180° (see FIG. 5 in particular). The portion 107 has the sides that are cammed outwardly when brought into engagement with the rail 62 or rail section 101, and after passing over the center of the rail 62 or rail portion 101 tightly clamp the rail 62 or rail portion 101. While that securely positions the tray to prevent sideways movement with respect to a rail 62 or rail portion 101, in order to insure no movement along the length of the rail 62 or rail portion 101, preferably a pin 108 (see FIG. 5) is provided extending radially toward the center of the semicircular portion 107 and adapted to cooperate with an opening (not shown) of corresponding shape and dimension formed in each rail 62 and rail section 101.

Exemplary channel-defining means comprise a pair of semicircular passageways 114 formed in the bottom of bottom section 89'' of the tray, and a pair of extension brackets 105 each defining a semicircular passageway corresponding to the tray passageways 114. The extension brackets are riveted (see rivets 116 in FIG. 3) to the tray bottom in operative association with the passageways 114 to form the channel-defining means. Metal strips 115 may be attached to portions of the tray bottom 89'' to receive the rivets 116 to insure that the extension brackets 105 are securely mounted (see FIG. 3). Stop means preferably are provided for limiting the movement of each of the rods 91 (particularly the legs thereof) with respect to the channel defining means. Stop means preferably include a spring pin 110 (see FIGS. 3 and 4) disposed in each leg of each U-shaped rod 91 and extending downwardly therefrom. The stop means further comprise means defining a pin-receiving groove 112 in open communication with each passageway 114 in the tray bottom, each groove 112 having end terminations 118 (see FIG. 3) for stopping movement of the pin 110 within the groove 112 before each rod reaches the end of each extension bracket 105 passageway.

When the bottom portion 89'' of the tray is formed, preferably a plurality of ribs 117 are formed therein to provide strength.

An exemplary tray assembly and the like according to the present invention having been described, a typical manner of construction and utilization thereof will now be set forth.

Figure 5:
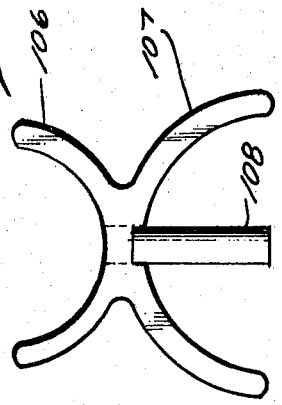
FIG. 5 is an end view of a rail-engaging member of the tray assembly of FIG. 4.

The tray sections 89', 89'' are vacuum formed from plastic, and bonded together to form the final tray body. The clips 90 are riveted to the cross portions of the U-shaped rods 91 and a pin 108 is stationarily mounted to each clip 90 as illustrated in FIG. 5. Thus spring pins 110 are inserted in openings formed in the legs or the rods 91, upstanding upwardly therefrom, and then the legs of the rods 91 are mounted in the passageways 114 formed in the bottom of the tray bottom 89'' so that the pins 110 extend into the grooves 112 between the end terminations 118 thereof. The extension brackets 105 are brought into operative association with the passageways 114 so that with the passages 114 they completely engulf the rod 91 legs, and then the brackets 105 are riveted in place with rivets 116 (see FIG. 3) passing through metal strips 115, the metal strips 115 having been attached to the surfaces of the tray bottom 89'' straddling the passageway 114 (see FIG. 3) prior to bonding of sections 89', 89'' together. The tray assembly 89 is now completely assembled.

To utilize the tray assembly 89, one merely grasps the rods 91 and pulls outwardly thereon until the right horizontal spacing of the clips 90 is obtained and then the clips 90 are pushed downwardly onto the rails 62, with the cutout 97 facing the head of the mattress 24. Movement of the rods 91 out of the passageways defined by the brackets 105 and tray cutout 114, is prevented by cooperation between stop pins 110 and groove terminations 118. When disposing the clips 62 over the rails 62, care is taken to make sure that each pin 108 is disposed in a cooperating opening in the rail 62. When it is no longer desired to use the tray assembly 89, the clips 90 are merely removed from the rail 62 by pulling upwardly on the rods 91, the rods 91 are pushed inwardly (see the left hand most tray assembly in FIG. 1), and the clips 90 are forced over the rail sections 101 (again care being taken to see that pins 108 align with openings in rail sections 101). Mounted in the storage position, the tray assembly 89 covers the toe board 99 of the bed assembly, while not interfering with the bed hardware (such as crank H).

Figure 6:
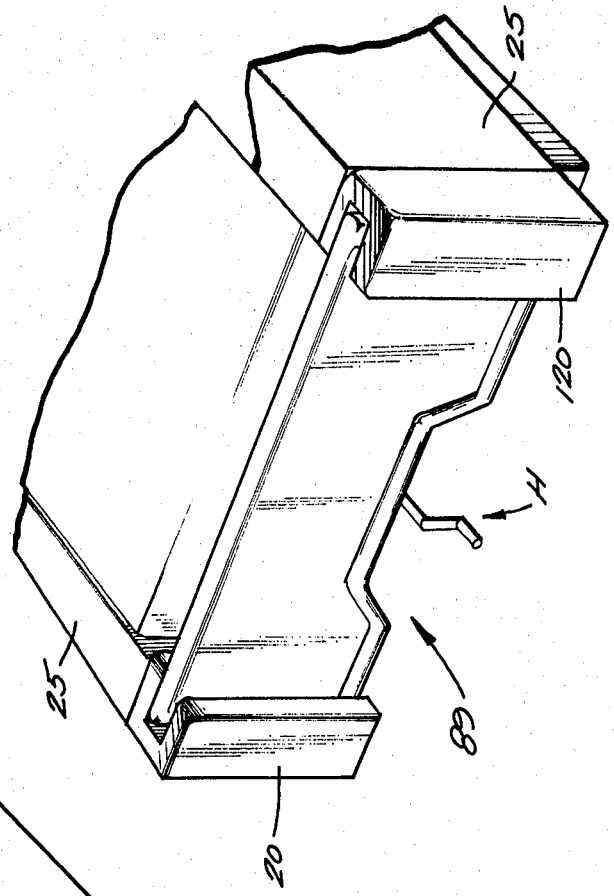
FIG. 6 is a detailed perspective view of an alternative manner of mounting a tray in a storage position in association with the bed assembly.

While the invention has been herein shown and described in what is presently conceived to be the most practical and preferred embodiment thereof, it will be apparent to those of ordinary skill in the art that many modifications may be made thereof within the scope of the invention. For instance, instead of mounting the tray assembly 89 on rail sections 101 on toe board 99, channel-shaped portions 120 (see FIG. 6) may be formed from the bolsters 25 and portions of the tray assembly 89 (depending upon the dimensioning of the channel-shaped portions 120) will be received by the channel-shaped portions 120 in the inoperative position (as illustrated in FIG. 6). Thus, the invention is to be accorded the broadest interpretation of the appended claims so as to encompass all equivalent structures and assemblies.

What is claimed is:

1. A tray assembly comprising: a body including a head portion, a foot portion, a pair of parallel side portions, and a substantially flat support surface that gently slopes downwardly from said head portion to said foot portion; a vertical lip provided upstanding from the support surface at said foot portion and at least portions of said side portions adjacent said foot portion; and means for mounting said body on a pair of generally parallel horizontally spaced supports so that an individual utilizing said tray can eat off of or write on said tray support surface generally horizontal although gently sloping downwardly from said head portion to said foot portion; said tray body being formed from two separate portions, a top portion and a bottom portion having corresponding circumferential definitions so that they fixedly fit together to form the body, and said top and bottom portions comprising injection molded plastic portions fixedly fitted together and defining a space therebetween.

2. A tray assembly as recited in claim 1 wherein said substantially flat support surface slope downwardly at an angle of about 0.5°.

3. A tray assembly as recited in claim 1 wherein said tray head portion includes a cutout formed therein for allowing an individual using the tray to position himself so that side portions of the tray are on either side of the individual's body.

4. A tray assembly as recited in claim 1 wherein said means for mounting said tray comprise adjustable means so that said tray may be securely supported by support structures having varying horizontal spacing.

5. A tray assembly as recited in claim 1 wherein said vertically upstanding lip is provided along the entire length of said side portions of said tray.

6. A tray assembly as recited in claim 1 wherein said mounting means comprise a pair of substantially U-shaped rods, and channel-defining means formed in association with the bottom of said tray body for mounting said rods for movement toward and away from said side portions of said tray.

7. A tray assembly as recited in claim 6 wherein said channel-defining means comprise a pair of open semicircular passageways formed in the bottom of said tray; a pair of extension brackets each defining a semicircular passageway corresponding to said tray passageways; and means for mounting said extension brackets to the tray bottom in operative association with said tray passageways to form said channel-defining means.

8. A tray assembly as recited in claim 7 further comprising stop means for limiting the movement of each of said U-shaped rods with respect to said channel-defining means; said stop means comprising a pin disposed in each leg portion of each U-shaped rod and extending outwardly therefrom, and means defining a pin-receiving groove associated with each tray passageway and formed in said tray bottom and having an end termination for stopping movement of said pin within said groove before each said rod reaches the end of each said extension bracket passageway.

9. A tray assembly as recited in claim 1 wherein said means for mounting said tray further comprise: a pair of clips, one mounted to extend parallel to each side of said tray, each clip formed of flexible material and having a first, support-engaging portion comprising a semicircular portion having a circumferential extent of greater than 180°; and a second, rod cross-section engaging semicircular portion attached to a rod cross-portion and extending opposite said first semicircular portion.

10. A tray assembly as recited in claim 9 wherein each said clip further comprises a pin extending radially toward the center of said semicircular portion, and adapted to cooperate with an opening formed in a support structure.

11. A tray assembly comprising a body having a substantially flat support surface; and adjustable means for mounting said body on a pair of generally parallel spaced supports so that said body portion may be securely supported by support structures having varying horizontal spacings;

said mounting means comprising a pair of substantially U-shaped rods, each having a pair of legs and a cross portion; a support-engaging member mounted on each cross portion; channel-defining means formed in association with the bottom of said tray body for mounting said rod legs for movement toward and away from side portions of said tray body; each said support-engaging member comprising an integral clip formed of flexible material and having a first, support-engaging portion comprising a semicircular portion having a circumferential extent of greater than 180°; and a second, rod cross-portion engaging semicircular portion attached to said rod cross-portion and extending opposite said first semi-circular portion wherein said channel-defining means comprises a pair of open semicircular passageways formed in the bottom of said tray; a pair of extension brackets each defining a semicircular passageway corresponding to said tray passageways; means for mounting said extension brackets to the tray bottom in operative association with said tray passageways to form said channel-defining means, said tray assembly further comprising stop means for limiting the movement of each of said U-shaped rods with respect to said channel defining means; said stop means comprising a pin disposed in each leg portion of each U-shaped rod and extending outwardly therefrom, and means defining a pin-receiving groove associated with each tray passageway and formed in said tray bottom and having and end termination for stopping movement of said pin within said groove before each said rod reaches the end of each said extension bracket passageway.

12. A bed assembly comprising: a mattress; a mattress supporting structure including a toe board; a pair of rails; means for mounting said rails so that a rail is disposed along each side of said mattress, at least adjacent the head portion of said mattress, said rails being substantially parallel and adapted to be disposed at the same vertical height; a tray assembly including a body portion, and means for mounting said body portion on said rails, said mounting means including a rail-engaging member for association with each rail; and said toe board comprising a pair of spaced rail sections attached thereto and upstanding therefrom and having substantially the same configuration as said bed rails; and wherein said means for mounting said body portion further comprises means for mounting said rail-engaging members so that the spacing thereof may be adjusted so that they may be mounted either on said rails or on said rail sections.

13. A bed assembly as recited in claim 12 wherein said means for mounting said rail-engaging members comprise a pair of substantially U-shaped rods each having a pair of legs and a cross portion, with said rail-engaging members mounted to said cross portions; and channel-defining means formed in association with the bottom of said tray body for mounting said rod legs for movement toward and away from side portions of said tray body.

14. A bed assembly as recited in claim 13 wherein said channel-defining means comprise a pair of open semicircular passageways formed in the bottom of said tray; a pair of extension brackets each defining a semicircular passageway corresponding to said tray passageways; and means for mounting said extension brackets to the tray bottom in operative association with said tray passageways to form said channel-defining means.

15. A bed assembly as recited in claim 14 further comprising stop means for limiting the movement of each of said U-shaped rods with respect to said channel-defining means; said stop means comprising a pin disposed in each leg portion of each U-shaped rod and extending outwardly therefrom, and means defining a pin-receiving groove associated with each tray passageway and formed in said tray bottom and having an end termination for stopping movement of said pin within said groove before each said rod reaches the end of each said extension bracket passageway.

16. A bed assembly as recited in claim 12 wherein each said rail-engaging member comprises a clip formed of flexible material and having a support-engaging portion comprising a semicircular portion having a circumferential extent of greater than 180°.

17. A bed assembly as recited in claim 12 wherein each rail and rail section has means defining an opening therein; and wherein each rail-engaging member comprises a pin extending therefrom shaped and dimensioned to be received by a said opening in said rail or rail section, to arrest movement of said rail-engaging member along the length of said rail or rail section.

18. A bed assembly as recited in claim 12 wherein said tray has means for defining a cutout in a head portion thereof so that said tray will not interfere with bed hardware when mounted on said rail sections, and so that when mounted on said rails an individual using the tray may position himself so that side portions of the tray are on either side of the individual's body.

19. A tray assembly comprising: a body including a head portion, a foot portion, a pair of parallel side portions, and a substantially flat support surface; a vertical lip provided upstanding from the support surface at said foot portion and at least portions of said side portions adjacent said foot portion; and means for mounting said body on a pair of generally parallel horizontally spaced supports so that an individual utilizing said tray can eat off of or write on said tray with said tray securely supported by said supports and said tray support surface generally horizontal although gently sloping downwardly from said head portion to said foot portion, and so that said tray may be securely supported by support structures having varying horizontal spacing; said mounting means comprising a pair of substantially U-shaped rods, and channel-defining means formed in association with the bottom of said tray body for mounting said rods for movement toward and away from said side portions of said tray, and said channel-defining means comprising a pair of open semicircular passageways formed in the bottom of said tray; a pair of extension brackets each defining a semicircular passageway corresponding to said tray passageways; and means for mounting said extension brackets to the tray bottom in operative association with said tray passageways to form said channel-defining means; and stop means for limiting the movement of each of said U-shaped rods with respect to said channel-defining means; and stop means comprising a pin disposed in each leg portion of each U-shaped rod and extending outwardly therefrom, and means defining a pin-receiving groove associated with each tray passageway and formed in said tray bottom and having an end termination for stopping movement of said pin within said groove before each said rod reaches the end of each said extension bracket passageway.

20. A tray assembly comprising a body having a substantially flat support surface; and adjustable means for mounting said body on a pair of generally parallel spaced supports so that said body portion may be securely supported by support structures having varying horizontal spacings;

said mounting means comprising a pair of substantially U-shaped rods, each having a pair of legs and a cross portion; a support-engaging member mounted on each cross portion; and channel-defining means formed in association with the bottom of said tray body for mounting said rod legs for movement toward and away from side portions of said tray body, said channel-defining means comprise a pair of open semicircular passageways formed in the bottom of said tray;

a pair of extension brackets each defining a semicircular passageway corresponding to said tray passageways;

means for mounting said extension brackets to the tray bottom in operative association with said tray passageways to form said channel-defining means; and stop means for limiting the movement of each of said U-shaped rods with respect to said channel-defining means, said stop means comprising a pin disposed in each leg portion of each U-shaped rod and extending outwardly therefrom, and means defining a pin-receiving groove associated with each tray passageway and formed in said tray bottom and having an end termination for stopping movement of said pin within said groove before each said rod reaches the end of each said extension bracket passageway.

* * * * *